US007621228B2

(12) United States Patent
Pryce

(10) Patent No.: US 7,621,228 B2
(45) Date of Patent: Nov. 24, 2009

(54) HAND STITCHING TOOL AND METHOD FOR USING THE SAME

(76) Inventor: Kathy S. Pryce, 23 Mirror Lake Rd., East Calais, VT (US) 05650

( * ) Notice: Subject to any disclaimer, the term of this patent is extended or adjusted under 35 U.S.C. 154(b) by 150 days.

(21) Appl. No.: 11/426,607

(22) Filed: Jun. 27, 2006

(65) Prior Publication Data

US 2006/0225632 A1 Oct. 12, 2006

Related U.S. Application Data

(63) Continuation-in-part of application No. 11/256,129, filed on Oct. 24, 2005, now abandoned.

(60) Provisional application No. 60/620,858, filed on Oct. 22, 2004.

(51) Int. Cl.
*D05B 85/02* (2006.01)
*D05B 91/00* (2006.01)

(52) U.S. Cl. ..... 112/169; 112/222

(58) Field of Classification Search ..... 112/169, 112/222, 223, 224, 226, 80.08, 475.18; 223/102, 223/103, 104; 163/1, 5; 428/95; 289/1.2, 289/1.5, 2, 17

See application file for complete search history.

(56) References Cited

U.S. PATENT DOCUMENTS 385,586 A 7/1888 Woods
448,845 A * 3/1891 Coe ..... 112/80.05
2,608,077 A * 8/1952 Suessman ..... 66/118
2,866,206 A * 12/1958 Gebert ..... 428/95
3,228,212 A 1/1966 Huber
3,309,259 A * 3/1967 Schwartz ..... 428/95
3,346,151 A * 10/1967 Porter ..... 223/104
3,442,235 A 5/1969 Gibson
3,541,980 A 11/1970 Barker
3,678,712 A 7/1972 Singleton
3,701,461 A * 10/1972 Louis et al. ..... 223/102
3,860,155 A 1/1975 Migliaccio
3,893,603 A * 7/1975 Rush ..... 223/104
4,124,153 A * 11/1978 Mann ..... 223/102
4,154,181 A * 5/1979 Massucci et al. ..... 112/475.18
4,182,527 A * 1/1980 Meehan ..... 289/1.5
4,229,864 A 10/1980 Rankin
4,273,058 A * 6/1981 Martushev ..... 112/80.05
4,306,510 A 12/1981 O'Brien (Continued)

*Primary Examiner*—Ismael Izaguirre
(74) *Attorney, Agent, or Firm*—Michael J. Weins; Jeffrey E. Semprebon

(57) ABSTRACT

A hand-held stitching tool for forming decorative patterns of yarn on mesh materials has a stitching needle with a blunt end and an elongated handle having a top surface and a bottom surface and sized for holding between the thumb and the index finger with the index finger resting along the top surface of the handle. Preferably, the handle is wide enough to allow the third finger to be supported by the handle, allowing the user to clamp the yarn with the third finger. The stitching needle has a distal end region with an eye passage bounded by flattened surfaces that are parallel to the top and bottom surfaces of the handle. A guide passage can be provided on the handle to carry the yarn along the handle. The tool is well suited for practicing the described methods for forming decorative loops and chain stitches on a mesh material.

21 Claims, 6 Drawing Sheets

U.S. PATENT DOCUMENTS 4,413,847 A 11/1983 Doyel
4,778,706 A * 10/1988 Katz ..... 428/131
4,871,602 A * 10/1989 Luker ..... 428/88
4,974,488 A * 12/1990 Spralja ..... 87/8
5,503,092 A * 4/1996 Aubourg et al. ..... 112/80.23
5,612,113 A * 3/1997 Irwin, Sr. ..... 428/95
5,654,065 A * 8/1997 Kishi ..... 428/86
D414,328 S * 9/1999 Shotton et al. ..... D3/28
6,740,386 B2 * 5/2004 Hutchison ..... 428/88
6,861,118 B2 * 3/2005 Kobayashi et al. ..... 428/95

* cited by examiner

HAND STITCHING TOOL AND METHOD FOR USING THE SAME

FIELD OF THE INVENTION

The present application is for a hand stitching tool suitable for use with stranded material such as yarn. The tool is multi-functional and can be used for a variety of stitching applications such as knitting, crochet, hooking stitches, needlepointing of canvas, as well as forming hooked rugs. The application also teaches multiple methods for use of the hand stitching tool with stranded materials so as to produce craft items such as needlepointed canvases, or novel hooked rugs.

BACKGROUND OF THE INVENTION

Over the years, there have been a variety of hand stitching tools, including darning needles, knitting needles, crochet hooks, and rug hooks for hooking rugs to work with yarns, cording, or threads. More recently, some of these tools have been used to create stitched patterns with metal strands. Each of these tools has had particular applications, and required different degrees of attention and skill to be effectively used.

Suturing needles with rectangular handles have been available, such as taught in U.S. Pat. No. 385,586 for a surgical application, where a skin-piercing needle is curved for use to suture an incision in a patient. The curved needle attaches to a rectangular handle that has a rectangular cross-section, and the handle provides a storage region for additional needles and a bobbin, in addition to providing a grip.

U.S. Pat. No. 3,442,235 provides another curved needle having a sharp point, which is used for stitching. The needle has a rectangular handle for gripping and a side-mounted guide for directing thread to the curved needle. The needle assembly is designed to assist the sewer in developing a chain stitch to form a seam between two pieces of material.

U.S. Pat. No. 3,228,212 teaches a knitting needle that has a blunt point with an eye therebehind and a substantially cylindrical spacer attached thereto. The needle is mounted to a basically cylindrical handle that, in one embodiment, has a front end with a flattened section where the flattened surfaces are at a 45° angle to the eye to facilitate control of the thread during knitting and enable faster working. This needle is designed for practicing a method for hand knitting which employs a single needle.

U.S. Pat. No. 3,678,712 teaches a combination crochet hook and "looping needle". It appears that the looping needle is used as an accessory when crocheting. Again, a spacer can be placed on the needle, and allows adjustment of loop size.

A variety of special tools have been developed for making rugs. These have classically employed one of two types of needles for hand crafting rugs, either a latch hook or a punch tool. The latch hook tool has a blunt hook with a latch which serves as a needle for threading precut strands through a needlepoint canvas and knotting them thereto. One such device is taught in U.S. Pat. No. 3,541,980. While this technique allows one to create a shag type rug with a design therein, the fabrication is labor intensive, since individual strands must be threaded through, and requires providing precut lengths of the yarn employed. Tools which attempt to overcome the deficiencies of the traditional latch hook tool are taught in U.S. Pat. Nos. 3,860,155 and 4,413,847.

The alternative technique for creating home crafted rugs is to employ a rug punch tool which employs a sharp needle to pierce a tightly woven fabric carrying a continuous strand of yarn therethrough; when pulled back, friction of the fabric keeps the yarn from following the needle, thereby creating a loop. U.S. Pat. No. 4,306,510 discloses one such tool.

A further limitation of the tools that are currently used for the making of craft rugs, whether hooked or punched, is that they are not suitable for finishing the edges of the rug. Thus, it is necessary to employ additional binding equipment to bind the edges. Furthermore, existing rug-making tools are not designed so that they can be effectively used without other paraphernalia. The use of punch tools requires supporting the material in a frame while working on the rug, while the use of a latch hook tool requires a large number of individual lengths of yarn, which are difficult to keep organized when transported. In fact, various supplemental equipment has been designed to help organization of the yarn strands, such as taught in U.S. Pat. Nos. 3,541,980; 4,229,864; and 4,413,847.

Additionally, most traditional needle crafts require considerable manipulation of the needle by the fingers of the user, making these crafts difficult and/or uncomfortable for users suffering from arthritis or similar ailments.

Thus, there is a need for a universal stitching tool that is simple to use and can be used for various craft tasks. Furthermore, there is a need for the development of a technique for using such a tool, or even an existing tool such as the needle taught in the '212 patent, to provide a hooked-type crafted material which is less labor intensive and which requires less attention to the mechanics of the operation by the tool's user, thereby reducing the level of concentration required by the user. There is also a need for a tool which reduces the amount of finger and/or wrist manipulation required by the user.

SUMMARY OF THE INVENTION

The present invention provides a hand-held stitching tool for manipulating yarn to provide various finished materials with various appearances such as knitted, crocheted, or the appearance of an open-looped crafted rug rather than the hooked appearance typically obtained in crafted rugs made using latch hooks or punch hooks. The present invention also discloses a method of fabricating hand-crafted stitched craft items for rugs or decorative materials. These craft items result from employing a collection of stitches that, when appropriately used, can provide a rug having a knotted open loop rug pattern with stabilized loops. The present invention also provides a method of forming a chain stitch which is integrated with a mesh, which is well suited for binding the edges of the mesh or fill areas of the mesh with yarn.

The hand-held stitching tool has a stitching needle and an elongated handle attached thereto. The elongated handle has suitable dimensions to be comfortably held by the user's hand. The elongated handle terminates in a first end region, to which the stitching needle is affixed, and a second end region.

In one preferred embodiment, the elongated handle is a plate-like structure having a top surface and a bottom surface. The plate preferably has a thickness t between about ⅛ to ⅜ inches. Preferably, this plate is substantially rectangular in overall shape, having a minimum length of about 2½ inches and more preferably about 3½ inches. The upper limit is chosen to be the approximate length of the average person's index finger so that, when the handle is so configured and is held between the thumb and the index finger with the index finger resting along the top surface of the handle, the handle can be comfortably accommodated in the hand of the user. The stitching tool in this position almost feels like an extension of the user's hand and naturally falls under the direction of the index finger. Having the handle formed as a rectangular plate also allows the handle to be readily grasped between the thumb and the index finger. When sufficient width is provided, this configuration allows the third finger of the hand to be supported by the handle. Being able to accommodate the third finger next to the index finger allows the yarn to run between the index finger and third finger so that the user can control tension as needed by clamping the yarn with the third finger, either against the handle or against the index finger. To support two fingers, it is preferred that the handle have a breadth B of at least about ¾ inch; a maximum breadth B is about 1½ inches to allow the handle to be held comfortably.

It is further preferred that the first end region of the elongated handle be substantially trapezoidal to reduce obstruction of the user's view of the stitching needle and to minimize interference between the handle and the mesh of a canvas material as the needle is passed through the canvas.

The stitching needle of the present tool is substantially cylindrical, and has a proximal end region and a distal end region. The proximal end region attaches to the first end region of the elongated handle, and typically is embedded therein. The distal end region forms a flattened region of the needle bounded by flattened surfaces that are preferably substantially parallel to the top surface and the bottom surface of the handle. The flattening of the distal end region results in an expanded cross section. The distal end region has an eye passage therethrough, and terminates in a blunt terminal surface so that the stitching needle passes through a fabric by sliding between the fibers rather than passing through the fibers. The blunt terminal surface also serves to prevent accidental puncture injuries to the user.

In one preferred embodiment of the stitching needle, the distal end region is configured similarly to the thread-engaging end region of a darning needle, which facilities threading of the stitching needle with yarn. The eye passage preferably has a substantially rectangular cross section to aid in threading the needle. It is also preferred that the sides of the eye passage diverge as they approach the flattened surfaces of the distal end region to assist in threading the yarn therethrough. It is also preferred that the eye passage have a minimum width of about 1/16 of an inch to facilitate threading of the needle with the normal range of yarns used for rug fabrication and knitting. If more robust yarns are needed, the minimum width can be increased. However, it is preferred for the eye passage to be limited to about ⅛ inch wide when the tool is to be used for rug making, so that the distal end region can be readily inserted between the mesh elements in the canvas meshes typically used in craft and hobby type rugs.

It is also preferred that the eye passage have an axis or quasi-axis that is substantially normal to the upper and lower surfaces of the handle. Having the eye passage so oriented will provide a constant referencing of the eye passage with respect to the hand so that the yarn threaded through the needle can be effectively manipulated.

It is generally preferred to maintain the extension of the needle beyond the handle to less than about 1½ inches, which will allow easy control of its position by with the hand as well as limit the length of the loops formed. When using the needle to form loops, is necessary to extend the needle the same distance beyond the element that serves to secure the loop in order to maintain a consistent loop length. When the loops are formed according to the method of the present invention discussed below, the securing element is a loop of the yarn which has been passed through a mesh material on which the loops are being formed. For full-length loops, standardizing the length of the loops can be readily accomplished by passing the full length of the needle through the securing element such that the first end of the elongated handle is brought into contact with the securing element before the stitching needle is withdrawn.

If shorter loops are desired, one or more spacers can be fitted to the stitching needle and positioned such that the spacer is used as an index for the length of the needle that passes beyond the securing element. Since the maximum pass-through of the stitching needle will be less, the resulting loop will be shorter. The spacers are preferably made of an elastomer and sized to grippably engage the cylindrical section of the stitching needle. Having the spacer formed of an elastomer will allow the spacer to slide over the expanded distal end region of the stitching needle and thus be placed on the stitching needle as needed.

It is preferred that means for guiding the yarn be provided and that this means be associated with the second end region of the elongated handle. A guide passage sized to accept the yarn passing therethrough in the second end region of the elongated handle can serve this function. Having the guide passage so positioned will carry the yarn along a path that passes by the elongated handle so that the yarn can be readily manipulated by the hand of the user while the hand grasps the handle.

In one preferred embodiment, the means for guiding the yarn is an extension that protrudes from the second end region of the elongated handle and has a configuration similar to that of the stitching needle. In this embodiment, the passage in the extension serves as the guide passage through which the yarn passes. Providing such an extension with a guide passage also facilitates threading of the means for guiding the yarn.

In a further preferred embodiment, a second extension is provided to allow two yarns to be employed. The second extension allows the use of two yarns to form an extra thick pile in a rug and/or the blending of two yarns of different character to provide different textures. When dual extensions are employed, it preferred for the handle to be at least 1 inch in breadth.

Forming the tool such that the means for guiding the yarn are similar in configuration to the stitching needle has multiple benefits beyond the ease of threading. First, it provides a place for storing unused spacers and thus maintains them in a location where they are available at all times and can be readily retrieved. Second, having the length of the yarn guide extend about the same distance as the preferred needle length allows the guides to be maintained in close proximity to the hand of the user in operation, thus shielding the guides from engaging objects in the vicinity of the hand when in use to reduce the risk of entanglement of the yarn passing therethrough.

The tool of the present invention has been found to be convenient for practicing the method of stitching of the present invention, which provides stitches that employ a series of basic steps for providing raised patterns on a open mesh canvas. These steps serve as the basis for variations which allow forming different raised patterns.

The basic steps start with selecting a starting point and securing the yarn at this position on the mesh with the aid of a needle. For the purpose of describing the method, the side of the fabric on which the stitching will predominantly reside is defined as the finished side. The yarn is secured to a predetermined cross member of the mesh at the location where the user desired to begin stitching. In most cases, the yarn is secured so as to form an initial loop that resides above the finished side of the canvas or, when the predetermined location is at the edge of the mesh canvas, extends beyond the edge.

The threaded needle is then passed from the finished side of a canvas under a cross member of the canvas which is adjacent to the cross member to which the yarn is secured, and thereafter is returned to the finished side of the canvas; this can be done by passing through another mesh opening or passing beyond the edge of the mesh. In the following description, stitching that extends beyond the edge of the canvas is considered to be equivalent to residing on the finished side of the mesh canvas.

The needle is then extended a predetermined distance beyond the cross member. When the needle is so extended, the yarn which has passed through the needle and under the cross member and thereafter returned above the canvas creates a base loop which has a base loop standing portion and a base loop running portion. The base loop standing portion, consisting of the yarn which has already passed through the eye of the needle, resides on the side of the needle where the yarn ultimately is fixed to the mesh, while the base loop running portion resides on the side of the needle where the yarn ultimately forms a yarn ball or skein.

The yarn is grasped on the base loop standing portion, between appendages of the other hand that is not holding the tool of which the needle is a part; preferably, the base loop standing portion is grasped between the index finger and the thumb of the other hand. Thereafter, the needle is withdrawn, leaving the base loop on the finished side of the canvas and the needle again residing above the canvas on the finished side of the canvas.

The needle is thereafter passed above the canvas through the base loop to form a finish loop which is now grasped with the second hand after releasing the grip on the base loop. The needle is then withdrawn from the base loop while the user maintains a grasp on a finish loop standing portion of the finish loop.

These steps can be reproduced to generate a decorative stitch when, after each cycle, the needle is advanced to an adjacent mesh opening and the steps recited above are reproduced from the new location to form a desired pattern of yarn on the mesh canvas.

While this basic stitch will generate a loop stitch, the density of coverage of the mesh will be relatively low and the loops will be subject to snagging and extending until secured by tensioning the loops at the expense of the size of adjacent loops.

One preferred variation of this stitch is an open loop stitch which is not subject to snagging and has better density of coverage. This variation results in loops of open yarn extending from the finished side of the mesh canvas to form a high pile surface where the individual loops are each secured to the mesh canvas.

Another preferred variation is to provide interlocking loops which interlock with each other and the mesh to provide a low profile plush chain stitch which lies in close proximity to the canvas. The latter is particularly useful for binding off the edges of the canvas or to provide fill between regions of a canvas finished with the loop stitch, thus providing greater freedom in the pattern of textures in the resulting material.

The open loop stitch is generated by a variation of the basic stitch which includes an additional step to secure the finish loop to the cross member to leave the finish loop remaining as an open loop on the finished side of the canvas. In this variation, the open finish loop is secured by introducing the additional step where, while the finish loop is still gripped in the other hand, pressure is applied to the yarn positioned between the handle and the fingers gripping the handle, and the thumb and the handle are further withdrawn from the canvas so as to constrict the base loop and tighten the yarn about the cross member to secure the finish loop thereto. It should be appreciated that the same effect is achieved if the needle is maintained stationary and the loop and mesh are pulled away, or if a combination of these two actions is done. Thereafter, the above described steps are repeated on adjacent cross members to form additional open loops. In this variation of the method, it is preferred for the yarn to be initially secured to the predetermined cross member by following the steps described above so as to secure the yarn by forming a finish loop that is tied to the predetermined cross member by a tightened base loop; the secured finish loop so formed can be considered to form an initial loop.

The interlocking loop low profile plush chain stitch is generated by another variation of the basic stitch. This variation requires that an initial loop be formed when the yarn is secured to the predetermined cross member. Thereafter, when the base loop standing portion is grasped, the initial loop is also grasped and the two loops are held together. The needle is then withdrawn, leaving a base loop on the finished side of the canvas and in side-by-side relationship with the initial loop. Thus, when the needle is withdrawn, the initial loop and the base loop are held together on the finished side of the canvas and the needle again resides above the canvas (on the finished side of the canvas). The needle is thereafter passed above the canvas through the initial loop and the base loop, passing first through the base loop. The pair of loops are released and the yarn fed through the paired loops is grabbed by the other hand and the needle is withdrawn from the pair of loops, generating a finish loop which is held by the second hand. These steps are reproduced using adjacent cross members and using the finish loop previously formed as the initial loop for forming the succeeding stitch to generate a low profile plush chain stitch either on the edge of the canvas or residing on the finished side. Since each finish loop serves as the initial loop for the subsequent stitch, the finish loops are held close to the canvas to provide a pattern having a lower profile than is provided by the open loop stitch discussed above.

The low profile plush chain stitch serves as an excellent binding off stitch to bind the exposed edges of the canvas material. When the canvas is fabricated from a material that is subject to fraying, it is frequently preferred that the needle be inserted one mesh opening away from the edge of the canvas and that the needle be brought above the canvas after it passes beyond the edge. This will eliminate the stress on the outermost fiber which is subject to fraying.

When yarn is employed to execute the above stitches on a mesh fabricated from durable woven material coated with an elastomer, the resulting looped fabric material is very flexible. The resulting material has multiple uses. It can be employed to make trim for garments, pillows, and other applications where a traditional mesh canvas material would be too stiff. In a preferred embodiment of the material, the flexible mesh material is formed with a mesh commercially available for use as a pad for placement under throw rugs to prevent slipping.

BRIEF DESCRIPTION OF THE FIGURES

FIG. 1 also illustrates two spacers designed to slidably engage the stitching needle to foreshorten its effective length.

As illustrated in FIGS. 11-17, the chain stitching can serve to bind off the edges of the canvas mesh. The same chain stitch can be employed to form a chain stitch on the surface of the canvas to delineate regions between the loop-filled regions.

DETAILED DESCRIPTION OF THE PREFERRED EMBODIMENTS

Figures 1, 2, 3, 4:
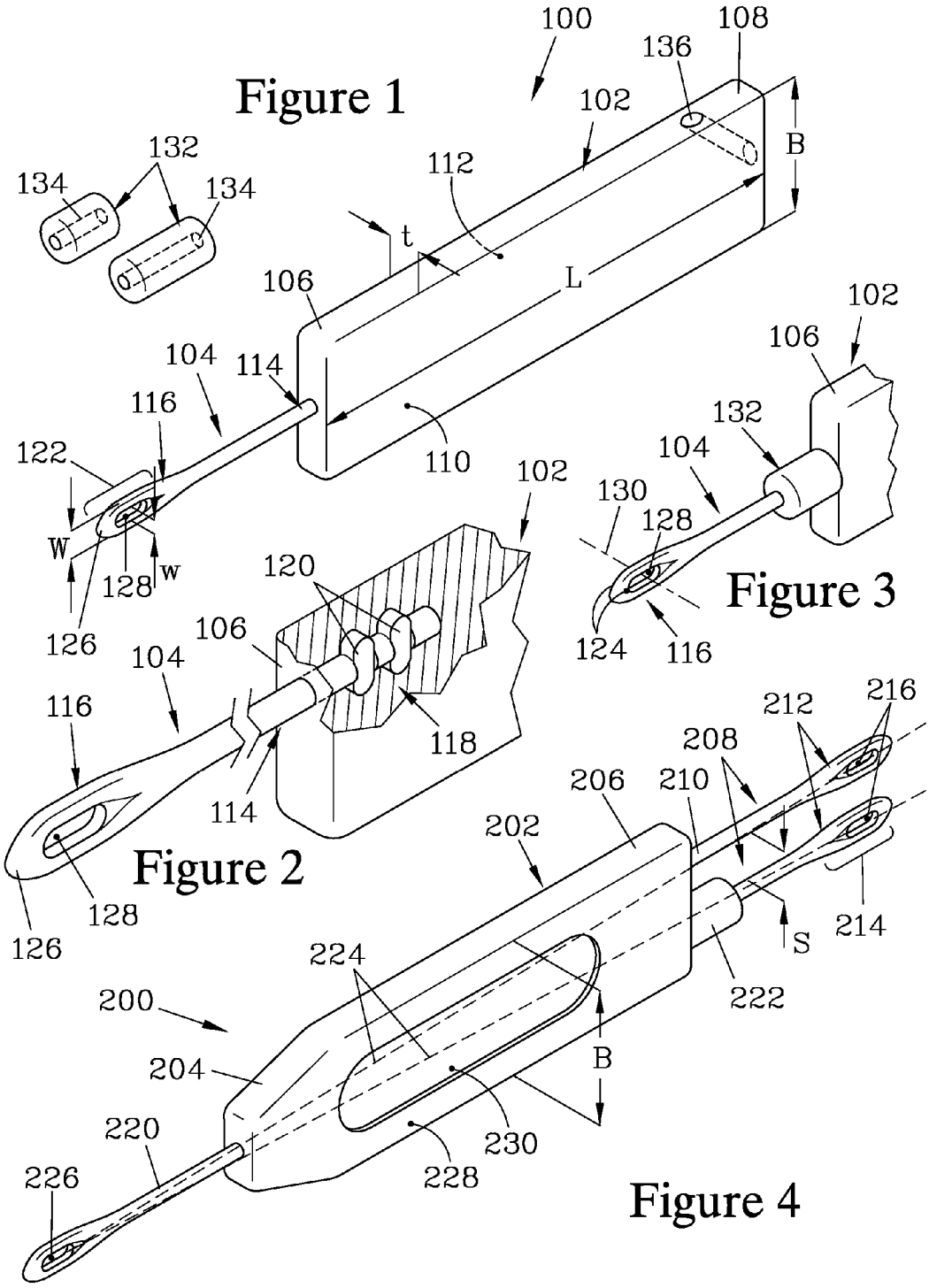
FIG. 1 is an isometric view of a stitching tool of one embodiment of the present invention, having a handle that is formed as a rectangular plate and a stitching needle extending therefrom. A guide passage in the handle serves to direct the yarn so the it will be carried along the side of the handle.
FIG. 2 is a breakaway section of the portion of the handle in which the needle is embedded in the tool shown in FIG. 1, showing how the needle is affixed therein.
FIG. 3 is partial view of FIG. 1, illustrating the needle and a portion of the handle with a spacer installed so as to cover part of the needle to foreshorten its effective length.
FIG. 4 is an isometric view of another embodiment of a stitching tool of the present invention, where the handle is formed as a plate and the top and bottom surfaces serve as surfaces to index the handle in the hand of a user. In this embodiment, the portion of the handle in which the needle is embedded has a substantially trapezoidal shape, and two yarn-carrying extensions are provided.

FIG. 1 illustrates one embodiment of a hand-held stitching tool 100 of the present invention. The hand-held stitching tool 100 has an elongated handle 102 and a stitching needle 104 attached thereto. The elongated handle 102 terminates in a first end region 106 and a second end region 108. The handle 102 is formed as a plate having a thickness t and bounded by a top surface 110 and a bottom surface 112, having an overall length L and a breadth B. The length L is selected to be comfortably held in the hand of a user. This length L of the top and bottom surfaces (110, 112) is preferably at least 2½ inches and not more than about 3½ inches so as to be comfortably held by a hand of a user. The minimum length L will assure that, when the handle 102 is gripped by the hand between the thumb and the index finger, a substantial portion of the index finger can be maintained in contact with the elongated handle 102. When the length L is increased to about 3½ inches, such is sufficient to accommodate the full length of an average index finger. Having the length so limited provides a fit between the index finger and the thumb such that the handle acts like an extension of the index finger. If the handle 102 were of greater length, it would either ride up on the hand or cause the handle 102 to extend substantially beyond the finger tips and thus limit control.

To further stabilize the handle 102 in the hand of the user, it is preferred that the breadth B of the elongated handle 102 be sufficiently great as to accommodate at least a substantial portion of a third finger of the hand which holds the stitching tool 100. Preferably, this breadth B is in the neighborhood of ¾ to 1½ inches. The thickness t of the handle 102 is preferably in the neighborhood of ⅛ to ⅜ of an inch. The minimum thickness will assure sufficient rigidity when subject to bending moments and the maximum thickness will still comfortably fit between the finger and the thumb.

The stitching needle 104 is a substantially cylindrical and has a proximal end region 114 and a distal end region 116. The proximal end region 114 attaches to the first end region 106 of the elongated handle 102. When the stitching needle 104 is metal and embedded in the handle 102, it is preferred for an embedded portion 118 of the stitching needle 104 to extend about ½ to ¾ inches into the handle 102. As shown in FIG. 2, when the handle is injection molded, flattened regions 120 are provided on the embedded portion 118 to secure the stitching needle 104 in the molded handle 102. The embedded portion 118 also serves to stiffen the handle 102.

The distal end region 116 provides an expanded section 122 of the stitching needle 104. The expanded section 122 of the distal end region 116 is flattened and has flattened surfaces 124 (labeled in FIG. 3) that are substantially parallel to the top and bottom surfaces (110, 112) of the elongated handle 102. The distal end region 116 terminates in a blunt terminal surface 126 which will facilitate the needle 104 passing around fibers rather than piercing fibers. An eye passage 128 is provided in the distal end region 116, the eye passage 128 having an eye axis 130 (shown in FIG. 3) which is substantially normal to the flattened surfaces 124 of the distal end region 116, as well as to the top and bottom surfaces (110, 112) of the elongated handle 102. The position of the eye axis 130 with respect to the top and bottom surfaces (110, 112) assures consistent presentation of the yarn to the mesh and to the hand of the user which is not gripping the handle 102, facilitating manipulation of the yarn or thread by the free hand when the yarn or thread has been passed through the mesh.

In the present embodiment, the eye passage 128 is substantially rectangular and similar to the eye of a darning needle. The eye passage 128 has a passage width w that is sufficient to pass thread or yarn therethrough. For typical yarns, a minimum width of about 1/16 inch will suffice. To accommodate more robust yarns, the passage width w can be increased to about ⅛ inch without increasing the width W of the expanded section 122 to a size which makes it difficult to pass through the mesh of a typical embroidering or rug canvas.

It is preferred that the length of the stitching needle 104 be limited so that the eye passage 128 is separated from the first end region 106 of the handle 102 by about 1½ inches. This will allow easy control of the stitching needle 104. It will also provide a maximum loop length which is reasonable when the stitching tool 100 is employed to produce hooked rugs by the method of the present invention.

To allow forming smaller loops, it is preferred for one or more spacers 132 to be provided, which are fabricated from an elastomer so as to be slipped over the expanded section 122 of the stitching needle 104, as shown in FIG. 3. The spacers 132 each have a spacer passage 134 therethrough of a diameter such that the spacer 132 will frictionally engage the proximal end region 114 of the stitching needle 104. In use, the spacer 132 is abutted against the first end region 106 of the elongated handle 102 and serves as an index for passing through a foreshortened section of the stitching needle 104.

The handle 102 of this embodiment is provided with a yarn passage 136 sized to accommodate a yarn or thread that passes through the eye passage 128 of the needle 104; the yarn passage 136 provides means for guiding yarn to direct it along the elongated handle 102. Having the yarn passage 136 in the second end region 108 of the handle 102 allows thread or yarn passed therethrough, and thereafter through the eye passage 128 of the stitching needle 104, to traverse a substantial portion of the top surface 110 of the handle 102 so that the yarn can be readily controlled by the fingers of the hand that grips the handle 102. Pressing the finger against the handle 102 with the thread or yarn clamped therebetween allows one to tension the thread or yarn as the stitching tool 100 moves away from a work surface, allowing the user to place the yarn in tension as the stitching is done without requiring a release or change in the position of the hand of the user on the handle 102. Similarly, the user could tension the yarn by clamping it between the fingers that grip the handle 102.

For fabricating hooked rugs, being able to tension the yarn with the hand used to hold the stitching tool 100 without changing the grip on the elongated handle 102 is most helpful, since it expedites the stitching process. With the yarn traversing the handle 102 as discussed above, the thread or yarn can be readily manipulated by the index finger and the third finger of the user without changing the grip on the handle 102.

FIG. 4 is an isometric view of a stitching tool 200 having an elongated handle 202 which is similar to the stitching tool 100 shown in FIGS. 1-3. The stitching tool 200 shares many of the features of the stitching tool 100 and differs in the details of the shape of the elongated handle 202 and in the means for guiding yarn along the side of the elongated handle 202. In this embodiment, the stitching tool 200 is designed to employ multiple yarns simultaneously.

The elongated handle 202 terminates in a first end region 204 and a second end region 206. In this embodiment, the first end region 204 is substantially trapezoidal to reduce the footprint of the first end region 204 and thereby reduce the region obscured to the user's vision by the first end region 204 when the stitching tool 200 is used to stitch onto a canvas.

In this embodiment, each of the means for guiding the yarns has an extension 208 having a proximal end region 210 and a distal end region 212, which terminates in an expanded region 214 with a guide passage 216. The proximal end region 210 of each of the extensions 208 attaches to the second end region 206 of the elongated handle 202. Having the extensions 208 configured similarly to a stitching needle 220 facilitates storing one or more spacers 222 when not being employed on the stitching needle 220 to regulate the length of the loops. Having the extensions 208 so configured places the guide passages 216 of the extensions 208 a distance from the elongated handle 202 and, with the guide passages 216 residing in the expanded region 214, allows the guide passages 216 to be large enough to readily thread yarn therethrough. Also, when the extensions 208 are so positioned, lines 224 joining the passages 216 and an eye passage 226 in the needle 220 traverse an upper surface 228 of the elongated handle 202 so that the control of the tension in the yarn can be readily controlled by the fingers of the hand of the user. Furthermore, maintaining the length of the extensions 208 at about 1½ inches will assure that the extensions 208 reside in close proximity to the hand of the user, and thus are shielded by the hand against catching on other objects as the stitching tool 200 is manipulated.

When the dual extensions 208 are employed, the breadth B of the elongated handle 202 should be maintained at a minimum of about 1 inch so as to accommodate a separation S between the extensions 208 sufficient that the guide passages 216 of the expanded regions 214 can be conveniently threaded with yarn or other stranded material.

To aid the user in properly positioning the thumb, both the upper surface 228 and the lower surface (not shown) are preferably provided with a recessed region 230.

The above described hand stitching tools can be used for a variety of classic stitching applications and have particular utility for forming the following stitches that have been developed for making crafted rugs and other decorative materials.

FIGS. 5-10 illustrate the steps of one method of the present invention for generating a stitch which, upon repetition, generates open loops which are each tied to a cross member of a mesh material to provide a deep pile such as seen in hand crafted rugs or similar craft items. The resulting pattern consists of side-by-side open loops rather than side-by-side strands and provides a more tufted appearance than the shag appearance resulting from the cut strands used for latch hook rugs. Furthermore, the loops are individually tied to an underlying mesh, and thus not subject to length changes due to snagging, as are classic hooked rugs.

Figure 5:
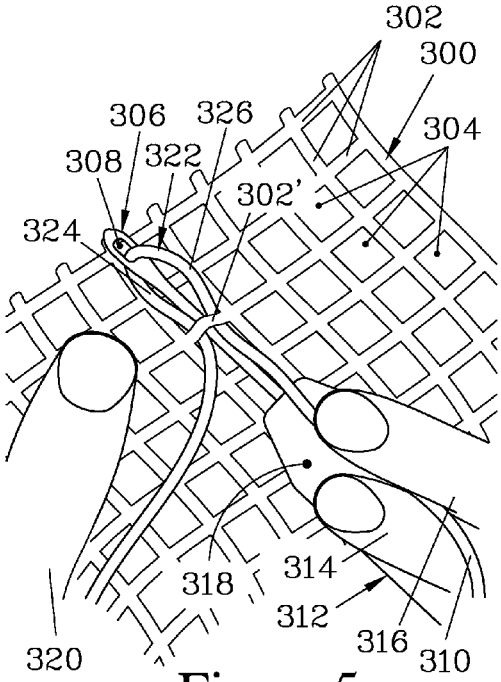
FIGS. 5-10 illustrate steps of a method for using a stitching tool of the type illustrated in FIGS. 1 and 4, to form stabilized open loops on a mesh canvas material in order to form a rug or similar craft item.

The methods describe below were developed with the stitching tools described above; however, these methods can be practiced with a variety of stitching tools to develop patterns on an open canvas mesh 300 that is formed by loosely woven fiber cross members 302 to provide an open matrix of substantially rectangular holes 304. Employing stitching tools such as illustrated in FIGS. 1 and 4 simplifies the control of the method and makes the method more ergonomically friendly. In all cases, the method employs a blunt stitching needle 306 having an eye passage 308 through which a strand of yarn 310 is passed. The needle 306 is preferably attached to an elongated handle 312. The eye passage 308 is sized to allow the yarn 310 to pass therethrough, but is also sized to allow the needle 306 to be readily inserted between adjacent cross members 302 in the mesh canvas 300. The yarn 310 is threaded through the eye passage 308 of the needle 306 and, when an elongated handle 312 is provided with the stitching needle 306 to form the stitching tool, the handle 312 of the stitching tool is grasped by the user in one hand, referred to hereinafter as the first hand. In FIG. 5, the first hand is represented in part by an index finger 314 and a third finger 316 which engage a top surface 318 of the elongated handle 312. A lower bottom surface of the handle (not shown) is grasped with the thumb (also not shown) of the first hand. The canvas mesh 300 is grasped by the other hand of the user, hereinafter referred to as the second hand. The second hand is shown, in part, by an appendage 320 which could be a thumb.

The method begins by securing the yarn to the canvas 300 at a desired location so as to form an initial loop. In the present method, the yarn 310 is secured by the same steps as are employed to form subsequent loops. Thus, while the description below is illustrated as forming an initial loop, the same steps are employed to form the additional open loops.

As shown in FIG. 5, the user has inserted the threaded stitching needle 306 from what will become the finished side of the canvas 300, hereafter referred to simply as the "finished side"; in the following description, the finished side is facing upward as illustrated in the figures. The stitching needle 306 is passed under one of the cross members 302 in the mesh canvas 300, and thereafter the needle 306 is again brought above the finished side of the canvas 300. The cross member 302' residing above the needle 306 when the needle 306 is so positioned is defined herein as an active cross member. The length of yarn 310 that is passed under the active cross member 302' and thereafter above the finished side forms a base loop 322, having two portions. The portion of the length of yarn 310 that has been passed through the eye passage 308 of the stitching needle 306 and is affixed with respect to the mesh 300 is defined as a base loop standing portion 324, while the remaining portion is defined as a base loop running portion 326 which is drawn from a skein of yarn, not shown.

Figure 6:
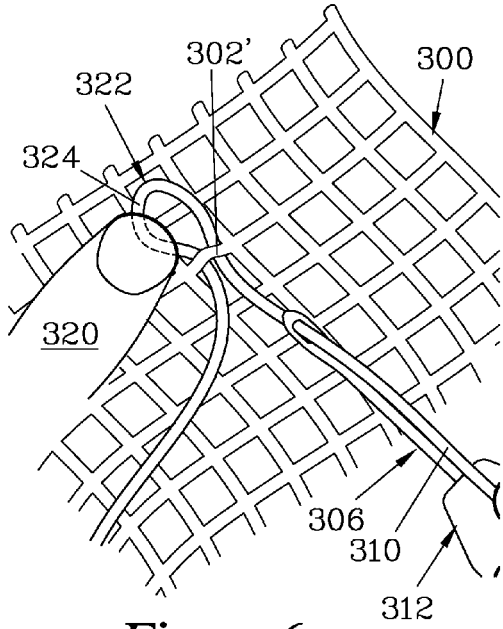

Once the stitching needle 306 has been positioned as illustrated in FIG. 5, the user then grasps the base loop standing portion 324 with the second hand, typically by using the thumb 320 to clamp the yarn of the standing portion 324 against the canvas 300 and the fingers of the hand not holding the handle 312, and then withdraws the stitching needle 306 from the mesh 300, as is illustrated in FIG. 6. It is important for the yarn 310 to be grasped on the base loop standing portion 324, rather than the base loop running portion 326, to allow the yarn 310 to pass through the eye passage 308 of the stitching needle 306 without obstruction as the stitching needle 306 is moved. The stitching needle 306 is retracted about the same distance as it was previously inserted under the active cross member 302'.

Figure 7:
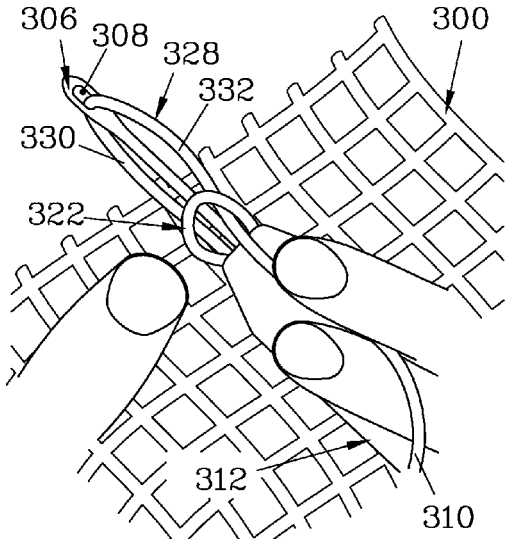
Figure 8:
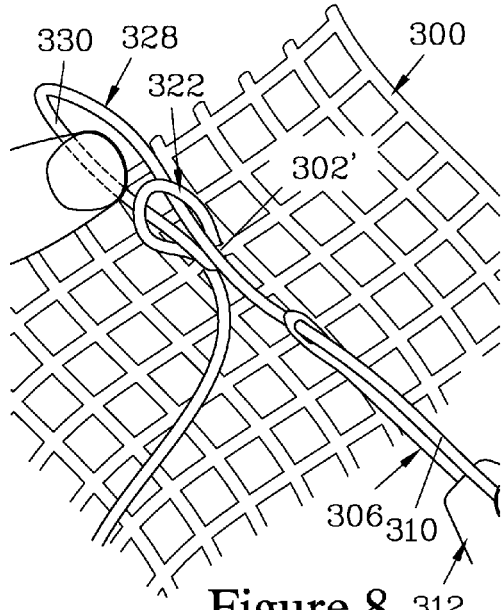

The user then inserts the stitching needle 306 over the active cross member 302' and through the base loop 322 and above the mesh 300, as shown in FIG. 7. The stitching needle 306 is inserted through the base loop 322 a desired distance to form a finish loop 328 of the desired size. Typically, the stitching needle 306 is inserted its entire length, until the handle 312 abuts the base loop 322, so that the size of the finish loop 328 is defined by the length of the stitching needle 306; this allows the user to readily form finish loops 328 of relatively constant size. It should be noted that inserting the stitching needle 306 through the base loop 322 causes the running portion of the base loop 322 to wrap around the active cross member 302', as best shown in FIG. 8. The finish loop 328 has a finish loop standing portion 330, formed by yarn 310 that has passed through the eye passage 308 of the stitching needle 306, and a finish loop running portion 332, which has not yet passed through the eye passage 308.

To complete the finish loop 328, the user releases the base loop 322, if such has not already been done, and grasps the finish loop standing portion 330 with the second hand. The user then pulls the stitching needle 306 out of the base loop 322, as is illustrated in FIG. 8, leaving the finish loop 328 on the finished side of the mesh canvas 300.

Figure 9:
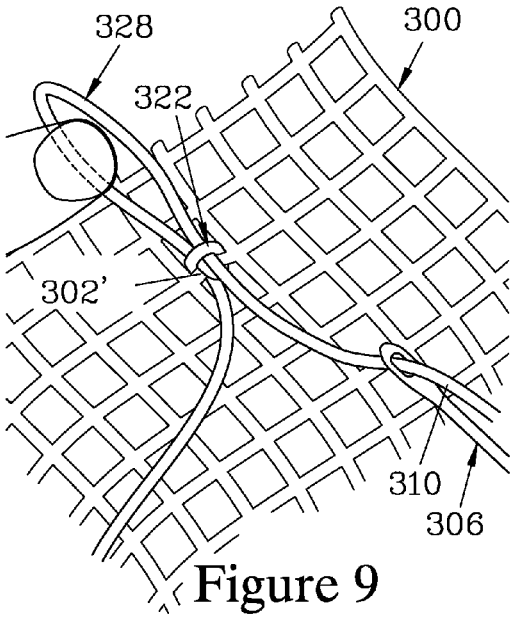

In this variation of the basic method, the finish loop 328 is secured to the active cross member 302' by the additional step of tightening the base loop 322 to form a knot. While the finish loop 328 is grasped (and pulled away from the mesh 300) by the finger and thumb of the second hand as illustrated in FIG. 9, the yarn 310 is secured against the elongated handle 312 with a finger and thereafter the needle 306 is drawn away from the mesh 300. As the needle 306 is drawn away and the finish loop 328 is pulled, it causes the base loop 322 to be drawn tight, securing the finish loop 328 to the active cross member 302', as shown in FIG. 9.

Figure 10:
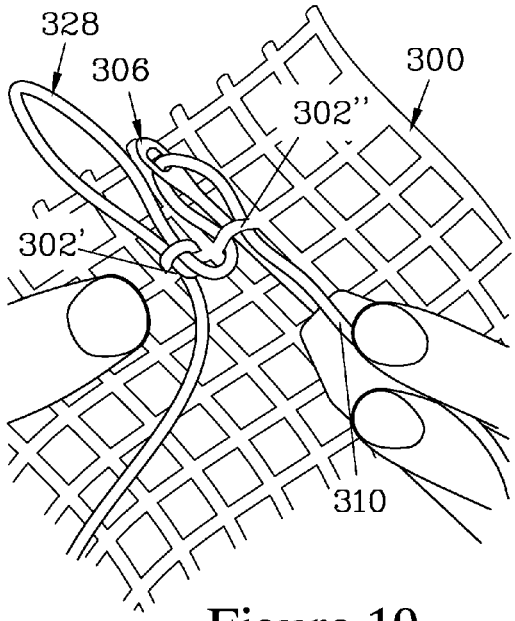

With the finish loop 328 thus formed (and serving as an initial loop in the illustrated example), the user may continue to pass the stitching needle 306 under the adjacent cross member 302", as shown in FIG. 10. This adjacent cross member 302" becomes the new active cross member, and the user repeats the above steps to form a new finish loop secured to the cross member 302". These steps are repeated on additional cross members 302 until the desired area of the mesh canvas 300 has been filled with finish loops.

When the above method employs the stitching tool of the present invention, the configuration of the stitching tool keeps the wrist stable and the hand aligned with the tool, so that the action of the tool becomes a push-pull movement as the tool is inserted back and forth in and out of the canvas. The motion is controlled by the elbow more than by the wrist and fingers, so that practicing the method using the stitching tool of the present invention should be easier and more comfortable for those with arthritis and other ailments, as it requires very little effort and strain on the joints.

FIGS. 11-17 illustrate the steps of another variation of the method of the present invention, this method serving to generate a chain stitch on the finished surface of an open canvas mesh 400. This method can be employed to bind an edge 402 of the open canvas mesh 400, as illustrated, or can be used to fill regions of the open canvas mesh 400 with a different texture than is provided by the loop stitch discussed above.

The open canvas mesh 400 employed is again formed by loosely woven fibers 404 that form an open matrix of substantially rectangular holes 406 bounded by cross members of the fibers 404. As with the loop stitch shown in FIGS. 5-10, the method for making the chain stitch employs a blunt stitching needle 408 having an eye passage 410 sized to allow a strand of yarn 412 to pass therethrough. The needle 408 is preferably attached to an elongated handle 414, and it is further preferred to use a stitching tool such as those shown in FIGS. 1 and 4 for the ergonomic benefits set forth above. Again, the eye passage 410 is also sized to allow the needle 408 to be readily inserted between adjacent fibers 404 in the mesh canvas 400. Again, the handle 414 is grasped by the user in a first hand, represented by an index finger 416 and a third finger 418 which grasp the elongated handle 414 against the thumb (not shown), while the canvas mesh 400 is grasped by the other hand of the user, hereinafter referred to as the second hand, represented in FIG. 11 by a thumb 420.

The chain stitch again employs the basic steps of the method as are employed in the loop stitch described above. The chain stitch requires an initial loop 422 to be formed when securing the yarn 412 to a predetermined one of the cross members 404 of the mesh canvas 400. In the example illustrated in FIG. 11, the initial loop 422 has been formed by employing the loop stitch discussed above to secure the initial loop 422 to an initial cross member 404'.

Figure 11:
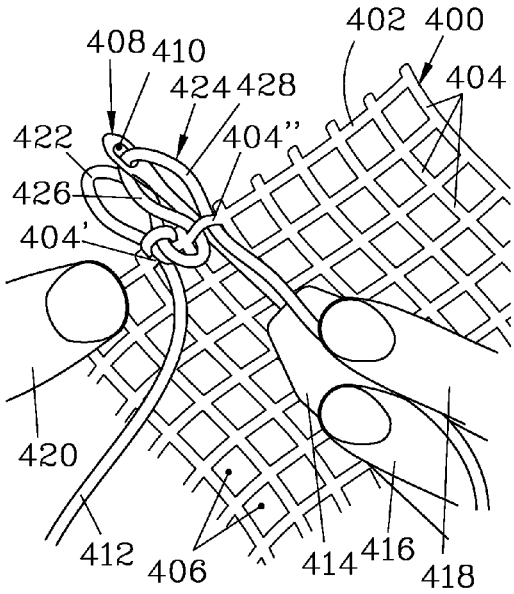
FIGS. 11-17 illustrate steps of a method for using a stitching tool of the type illustrated in FIGS. 1 and 4 to form a chain stitch which interlocks with the mesh and provides a plush filling of the mesh.

As shown in FIG. 11, the user passes the threaded stitching needle 408 from the finished side of the canvas 400 under an active cross member 404" that is adjacent to the initial cross member 404' on the same fiber 404. The needle 408 is then again brought above the finished side of the canvas 400; in the example illustrated, where the stitches are formed on the edge 402 of the mesh canvas 400, the needle 408 is simply extended beyond the edge 402, and for purposes of practicing the method, the eye passage 410 resides above the finished side of the mesh 400. Typically, the needle 408 is brought to the finished side of the canvas 400 after having passed only under the active cross member 404", as illustrated. However, as discussed below with regard to FIGS. 18 and 19, in some cases it is desirable to pass the needle under two fibers to reduce the risk of fraying or to provide a different decorative appearance.

The needle 408 is then extended a predetermined distance beyond the active cross member 404". The length of yarn 412 passed under the active cross member 404" and extending therebeyond, residing above the mesh 400, forms a base loop 424 having two portions. The portion of the yarn 412 that has been passed through the eye passage 410 of the stitching needle 408 is defined as a base loop standing portion 426, while the remaining portion which has not yet passed through the eye passage 410 is defined as a base loop running portion 428.

Figure 12:
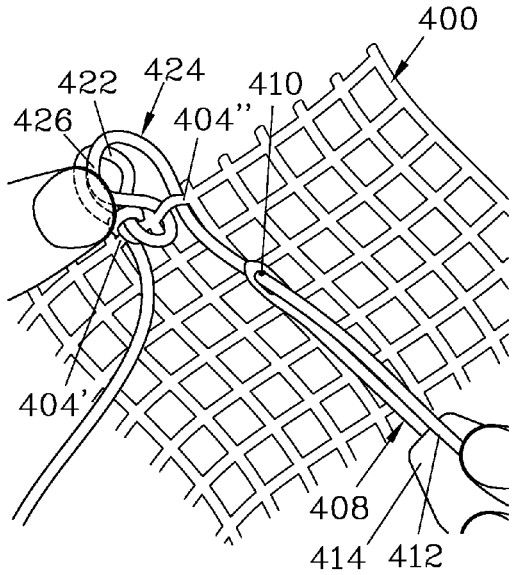

Once the stitching needle 408 has been positioned as shown in FIG. 11, the user grasps the base loop standing portion 426 from above the mesh 400 with the second hand. In this variation of the basic method, the base loop standing portion 426 is held against the initial loop 422 such that the initial loop 422 and the base loop 424 lie alongside each other, as shown in FIG. 12. The depth to which the stitching needle 408 is inserted under the active cross member 404" should be such as to form the base loop 424 about the same size as the initial loop 422.

While grasping the base loop standing portion 426 and the initial loop 422 with the second hand, the user withdraws the stitching needle 408 from the mesh 400, as is illustrated in FIG. 12. Again, it is important for the yarn 412 to be grasped on the base loop standing portion 426, rather than the base loop running portion 428, to allow the yarn 412 to pass through the eye passage 410 of the stitching needle 408 without obstruction as the stitching needle 408 is withdrawn. The stitching needle 408 is withdrawn away from the canvas 400 a distance about the same as the distance it was previously inserted under the active cross member 404".

Figure 13:
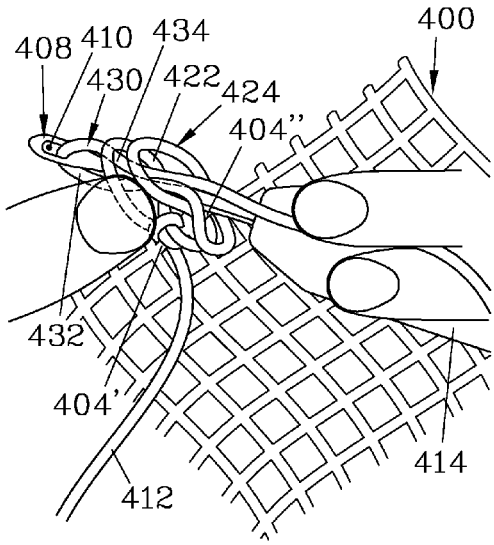
Figure 14:
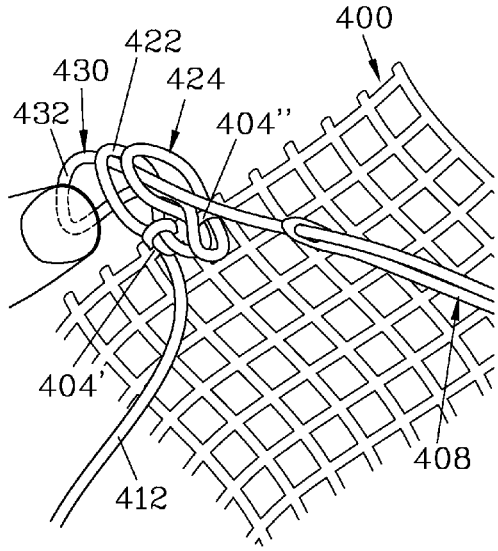

The user then inserts the stitching needle 408 over the active cross member 404" and through the base loop 424. In this variation of the basic method, the stitching needle 408 is also inserted through the initial loop 422, as shown in FIG. 13. The stitching needle 408 is inserted in a direction substantially parallel to the direction from the active cross member 404" toward the initial cross member 404'; thus, the stitching needle 408 is inserted from the direction in which the stitching is progressing along the canvas 400, and passes first through the base loop 424 and then through the initial loop 422. The needle 408 is inserted through the base loop 424 and the initial loop 422 a desired distance to form a finish loop 430. In this variation of the basic method, the finish loop 430 is similar in size to the initial loop 422. As with the loop stitch discussed above, inserting the stitching needle 408 through the base loop 424 causes the yarn 412 connected to the base loop running portion 428 to wrap around the active cross member 404", as best shown in FIG. 14, thereby connecting the yarn 412 to the active cross member 404". The finish loop 430 has a finish loop standing portion 432, formed by yarn 412 that has passed through the eye passage 410 of the stitching needle 408, and a finish loop running portion 434, which has not yet passed through the eye passage 410.

The user then releases the base loop 424 and the initial loop 422 and grasps the finish loop standing portion 432 with the second hand, as shown in FIG. 14. The user then pulls the stitching needle 408 out of the initial loop 422 and the base loop 424 while the finish loop 430 is grasped by the finger and thumb of the second hand, and withdraws the needle 408 away from the mesh 400. It should be noted that, unlike when forming the loop stitch discussed above, the yarn 412 is not clamped against the handle 414 (shown in FIGS. 11-13) while withdrawing the needle 408, and thus the base loop 424 is not drawn tight as the needle 408 is drawn away when forming the chain stitch. The chain stitch is stabilized by frictional resistance of the yarn 412 against the cross members 404 and, unless subsequently secured, the stitches can be removed by pulling the yarn 412 away from the canvas 400.

Figure 15:
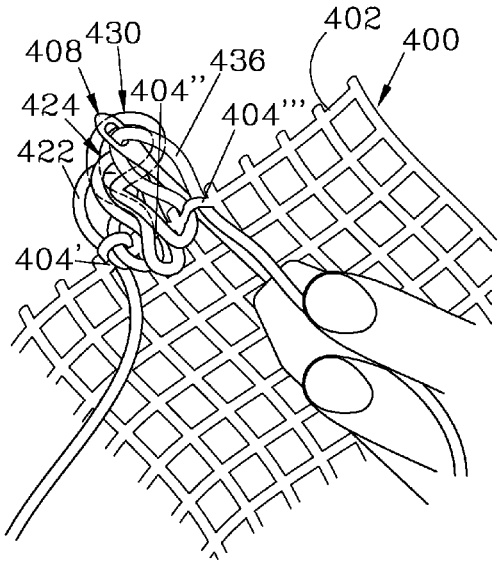
Figure 16:
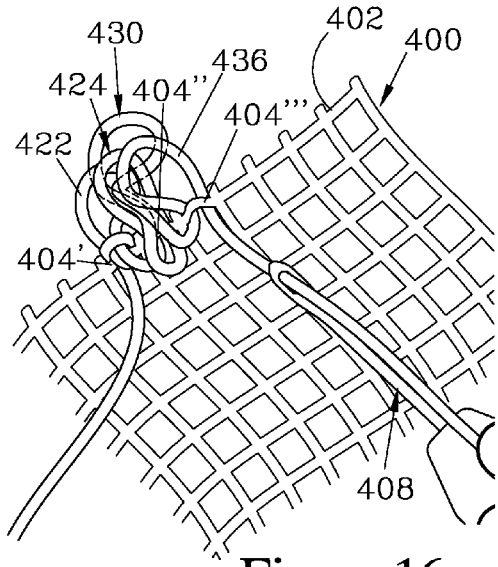
Figure 17:
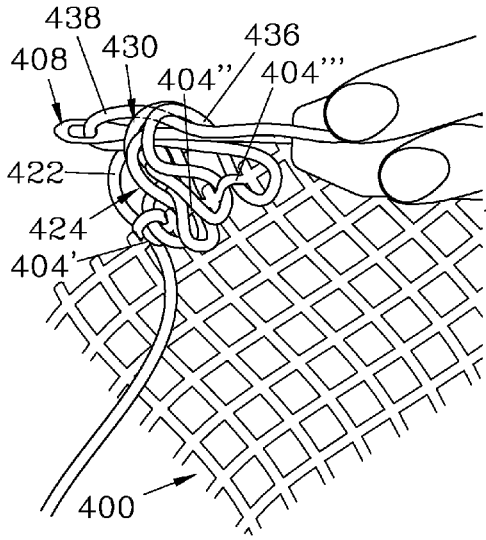

To continue the chain stitch, the user passes the stitching needle 408 under the next cross member 404'", as shown in FIG. 15 (for greater clarity, the thumb 420 is not shown in FIGS. 15 through 17). This next cross member 404'" becomes the new active cross member, and the finish loop 430 serves as the initial loop for the next stitch. The user repeats the steps to form a new base loop 436, as shown in FIGS. 15 and 16, which is then grasped alongside the previous finish loop 430 while the needle 408 is withdrawn from under the new active cross member 404'", as shown in FIG. 16, and then inserted through both loops (436, 430) to form a new finish loop 438, as shown in FIG. 17. The needle 408 is then withdrawn and these steps are repeated on adjacent cross members 404 until the edge 402 of the mesh canvas 400 has been bound or until the desired area of the mesh canvas 400 has been filled with chain stitches.

Once the desired chain stitches have been made, the chain stitches are then secured to the canvas 400 to prevent them from being pulled out. Such can be done readily by making two to three stitches following the above steps, but making each stitch on the same cross member 404 of the canvas 400. Alternatively, the yarn 412 could be secured by tying the yarn 412 to the canvas 400 or by forming a loop stitch according to the steps discussed above in the description of FIGS. 5-9.

While the above description employs a loop stitch such as shown in FIGS. 5-9 to form the initial loop 422, the initial loop could be formed by other methods. One preferred technique is to form an unsecured loop by passing the threaded needle 408 under the initial cross member 404', extending it a desired length, then grasping the standing portion of the resulting loop and retracting the needle 408; this initial loop is then secured by making two or three chain stitches on the initial cross member 404', by following the steps discussed above and shown in FIGS. 11-14, but not advancing to adjacent cross members 404. The finish loop of the last of such chain stitches then forms the initial loop for the chain stitch formed around the active cross member 404".

Also, while the steps shown for the chain stitch have been illustrated with respect to the binding of the edge 402 which is formed by the outermost fiber 404 of the mesh 400, the same steps could have been practiced on an inner fiber 404 and in this way create a fill consisting of plush, low profile loops.

Figure 18:
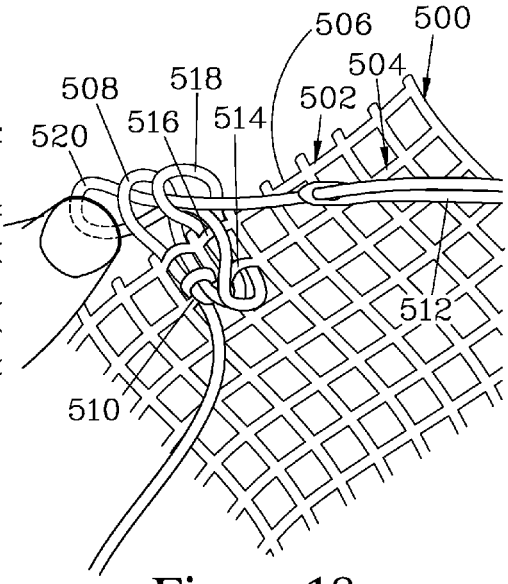
FIGS. 18 and 19 illustrate a binding chain stitch similar to that shown in FIGS. 11-17, but where the yarn is passed under two cross members of the mesh canvas to reduce susceptibility to fraying.
Figure 19:
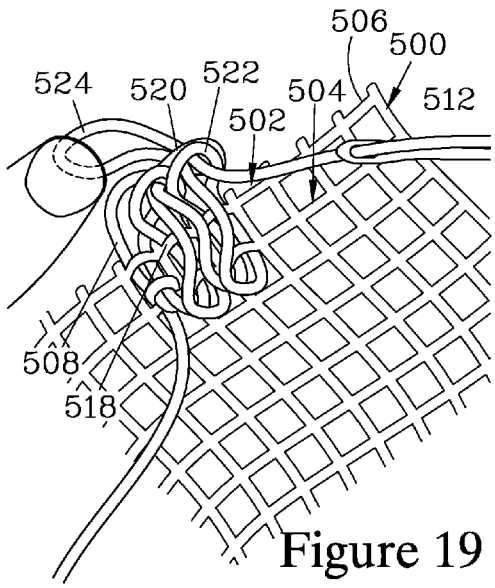

FIGS. 18 and 19 illustrate a variation of the chain stitch discussed above and shown in FIGS. 11 through 17, this variation being particularly well suited for use with a canvas mesh 500 having an outer fiber 502 that is susceptible to fraying. FIG. 18 shows the method at the same point as is shown in FIG. 14, while FIG. 19 shows the method when an additional stitch is being made. This variation can also be done to form a different appearance when binding the edge of a mesh canvas material.

In this variation of the method, the stitches are connected to both the outer fiber 502 and to an inner fiber 504 that is adjacent and parallel to the outer fiber 502; the outer fiber 502 defines an edge 506 of the canvas mesh 500. An initial loop 508 is formed on an initial inner cross member 510 that forms a section of the inner fiber 504. A needle 512 is then passed under an adjacent inner cross member 514, which is adjacent to the initial inner cross member 510 on the inner fiber 504. In this method, the needle 512 is additionally passed under an outer cross member 516, which is the section of the outer fiber 502 that is parallel to the adjacent inner cross member 514, when forming a base loop 518. The needle 512 is then withdrawn while the base loop 518 and the initial loop 508 are held. Then, while the base loop 518 and the initial loop 508 are held together, the needle 512 is passed over the inner cross member 514 and the outer cross member 516 when inserting the needle 512 through the base loop 518 and the initial loop 508 to form a finish loop 520. Forming the stitch connected to both the fibers (502, 504) helps secure the outer fiber 502 to prevent it from fraying.

FIG. 19 shows the method after a new base loop 522 has been formed, and is held against the earlier-formed finish loop 520 while the needle 512 is inserted therethrough to form a new finish loop 524.

Figure 20:
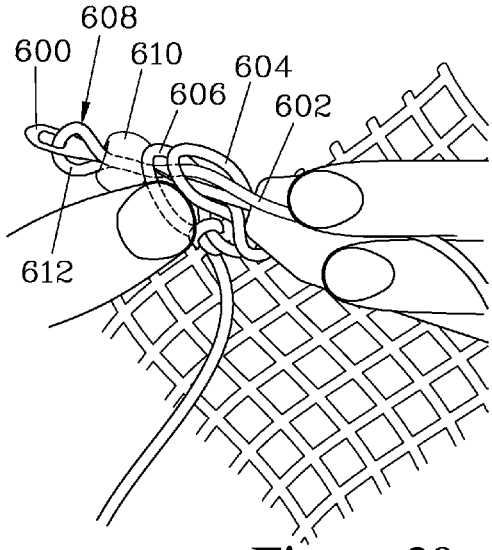
FIGS. 20 and 21 illustrate a binding stitch similar to that shown in FIGS. 11-17, but where beads are threaded onto the yarn to provide a decorative effect for the binding.
Figure 21:
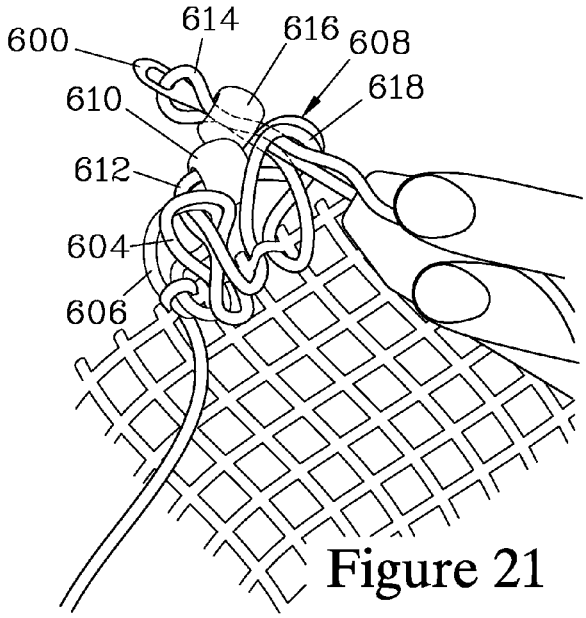

FIGS. 20 and 21 illustrate a method similar to that shown in FIGS. 11-17, but where a beaded edge is formed. FIG. 20 illustrates the method at the same point as is shown in FIG. 13, while FIG. 21 illustrates the method at the same point as is shown in FIG. 17.

FIG. 20 shows the method when a needle 600 threaded with yarn 602 is passed through a base loop 604 and an initial loop 606 to form a finish loop 608. In this method, the needle 600 is also inserted through a bead 610 such that the finish loop 608 protrudes from the bead 610. The user then grasps a finish loop standing portion 612 extending beyond the bead 610 and withdraws the needle 600. The bead 610 becomes secured onto the yarn 602 when the finish loop 608 is employed as the initial loop for forming a subsequent finish loop 614, as shown in FIG. 21. A second bead 616 is slipped over the needle 600 after the needle 600 has been passed through a subsequent base loop 618 and the finish loop 608 to form the subsequent finish loop 614, and the second bead 616 becomes secured when the needle 600 is passed through the subsequent finish loop 614 when forming a following finish loop.

Figure 22:
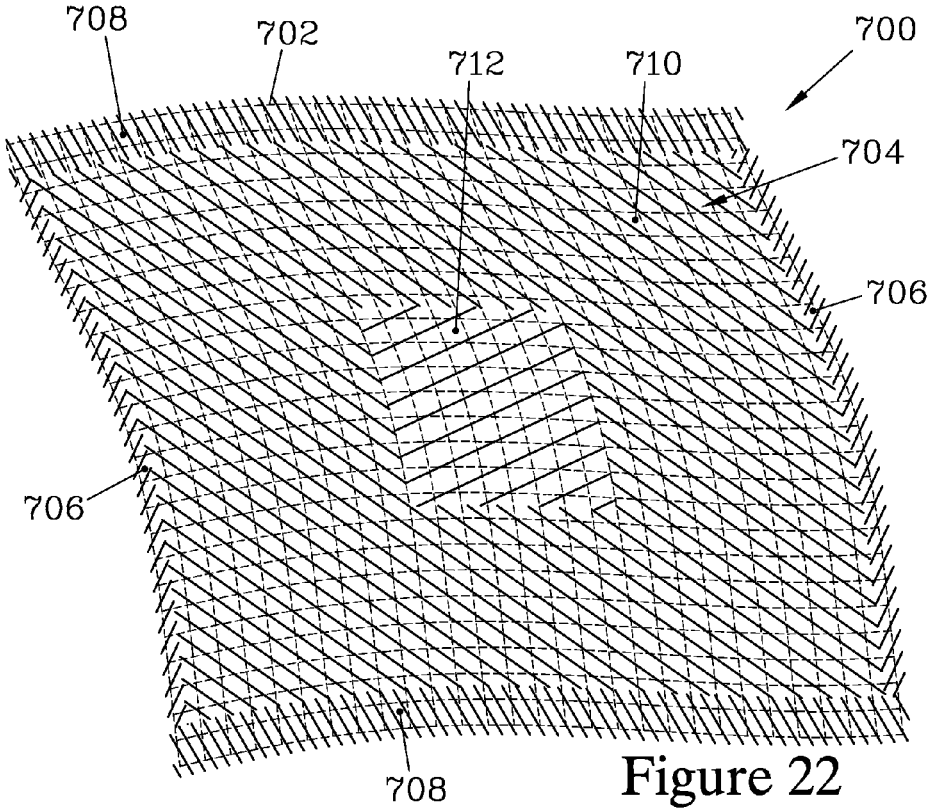
FIG. 22 schematically illustrates a craft item formed from a mesh that has been provided with a looped overlayer having border regions, a looped region, and a plush chain-stitched region.

FIG. 22 is a schematic view of one example of a fabric 700 made with yarn that has been stitched onto a soft compliant mesh 702 and results in a looped fabric which is further characterized below. The fabric 700 can be readily formed using the stitching tool of the present invention to attach yarn to the soft compliant mesh 702 employing one or more of the looping stitches illustrated in FIGS. 5 through 21. The resulting fabric 700 is a soft, flexible, compliant material that has utility in a variety of applications such as decorative trim for garments, pillow covers, and other applications where a traditional mesh canvas material would be too stiff. For the fabric 700, the mesh 702 employed is fabricated from durable woven material coated with an elastomer and forms a base layer, with one of the surfaces of the mesh 702 being chosen as the finished side as discussed above with regard to the method. The mesh 702 which forms the base can employ a material such as those commercially available for use as a pad for placement under throw rugs to prevent slipping. One source of the material, Leggett & Platt, Vantage Industries of Atlanta Ga., sells its pads under the trademark Rug Safe®. This material employs polyester fibers covered with polyvinyl, and is both washable and flame retardant.

A looped overlayer 704 is formed on the mesh 702, and resides predominately above the finished side of the mesh 702. This looped overlayer 704 is formed and attached to the mesh by stitching yarn onto the mesh 702 using the methods illustrated in FIGS. 5 through 21 and described above. Depending on the selection of the stitches made by the user, the resulting pattern can be changed. However, in all cases the fabric 700 will have the mesh 702 which serves as a base layer having a finished side and the looped overlayer 704 attached thereto.

For the fabric 700 illustrated in FIG. 22, the resulting pattern of the looped overlayer 704 results from employing different stitches for different regions. The looped overlayer 704 illustrated has a pair of first boundary regions 706, where the edges of the mesh 702 are bound by using the chain stitch method illustrated in FIGS. 11-17, and a pair of second boundary regions 708, where the edges of the mesh 702 are bound by using the chain stitch method illustrated in FIGS. 18 and 19. The looped overlayer 704 also has a looped design region 710, which is filled with decorative open loops of desired colors formed by using the loop stitch method illustrated in FIGS. 5-10. Finally, the looped overlayer 704 has a plush design region 712, which is filled with chain stitching formed by the method illustrated in FIGS. 11-17.

While the novel features of the present invention have been described in terms of particular embodiments and preferred applications, it should be appreciated by one skilled in the art that substitution of materials and modification of details obviously can be made without departing from the spirit of the invention.

What I claim is:

1. A hand-held stitching tool comprising:

an elongated handle terminating in a first end region and a second end region, said elongated handle being bounded by top and bottom surfaces for engaging with a thumb and an index finger and a complimentary finger of the user, the elongated handle being used for gripping the stitching tool in a user's hand;

a stitching needle having a proximal end region and a distal end region, said distal end region having an eye passage therethrough and terminating in a blunt terminating surface, and said proximal end region joining said first end region of said elongated handle; and means for guiding the yarn, said means being associated with said second end region of said elongated handle and having a first guide passage sized to accept the yarn passing therethrough.

2. The hand-held stitching tool of claim 1 wherein said means for guiding the yarn further comprises:

a first extension extending from said second end region of said elongated handle, said first guide passage being provided on said first extension.

3. The hand-held stitching tool of claim 2 wherein said means for guiding the yarn further comprises:

a second extension extending from said second end region of said elongated handle parallel to said first extension, said second extension having a second guide passage sized to accept the yarn passing therethrough.

4. The hand-held stitching tool of claim 3 wherein the hand-held stitching tool further comprises:

at least one spacer formed of an elastomer having a spacer passage therethrough configured to slidably, resistively engage either of said needle and said extensions.

5. A hand-held stitching tool for working a yarn, the hand-held stitching tool comprising:

an elongated handle terminating in a first end region and a second end region, said elongated handle being substantially flattened so as to be bounded by top and bottom surfaces for engaging with a thumb and an index finger and a complimentary finger of the user, the elongated handle being used for gripping the stitching tool in a user's hand; and a stitching needle having a proximal end region and a distal end region, said distal end region having an eye passage therethrough and residing therein, providing a flattened section of said distal end region end formed by planar surfaces, said distal end region terminating in a blunt terminating surface, said distal end region of said needle is being expanded and said planar surfaces being substantially parallel to said top and bottom surfaces of said handle, said eye passage being configured to engage the yarn when passed therethrough so as to pass the yarn through a material with said distal end region as said distal end region of said stitching needle is inserted through the material, and said proximal end region extending from and affixed to said first end region of said elongated handle.

6. The hand-held stitching tool of claim 5 wherein said elongated handle has a length L between about 2½ and 3½ inches, a breadth B of between ¾ and 1½ inches, and a thickness t between about ⅛ and ⅜ inches, and further wherein said first end region is substantially trapezoidal.

7. The hand-held stitching tool of claim 5 wherein said handle further comprises:

a recessed region in at least one of said top surface and said bottom surface.

8. A method of generating a decorative stitch with a yarn on a finished side of a mesh material using a needle through which the yarn is threaded, the method comprising the steps of:

a. securing the yarn to a predetermined cross member on the mesh;

b. passing the threaded needle from the finished side of the material through a mesh opening and under a cross member of the mesh material adjacent the predetermined cross member on the mesh material and thereafter returning the needle to the finished side of the material;

c. extending the needle a predetermined distance beyond the cross member so as to create a base loop having a base loop standing portion and a base loop running portion;

d. grasping the base loop standing portion with the hand not holding the needle;

e. withdrawing the threaded needle from the mesh material while maintaining a grasp on the base loop standing portion;

f. inserting the threaded needle through the base loop while maintaining the needle above the material, generating a finish loop having a finish loop standing portion and a finish loop running portion;

g. releasing the grasp on the base loop and grasping the finish loop standing portion;

h. withdrawing the threaded needle from the mesh material while maintaining a grasp on the finish loop standing portion so as to maintain the finish loop above the mesh.

9. The method of claim 8 for forming a stabilized open loop stitch on finished side of the mesh material after step h., the method further comprising the step of:

l. applying tension to the base loop to stabilize the yarn and drawing the base loop tight, generating a loop knot securing the finish loop to the cross member to provide a new secured cross member on the mesh.

10. The method of claim 9 further comprising the steps of:

j. repeating steps b. through l. on subsequent cross members of the mesh material until finish loops are provided across a desired region of the mesh material;

k. forming a chain stitch initial loop secured to a predetermined boundary position on the mesh material external to the desired loop-stitched region;

l. passing the threaded needle from the front side of the material under a cross member of the mesh adjacent to the predetermined boundary position and thereafter extending the needle beyond the edge of the material;

m. extending the needle a predetermined distance beyond the cross member so as to create a chain stitch base loop having a chain stitch base loop standing portion;

n. grasping the chain stitch base loop standing portion as well as the chain stitch initial loop with the hand not holding the needle such that the chain stitch base loop and the chain stitch initial loop are held against each other;

o. withdrawing the threaded needle from the mesh material while maintaining a grasp on the chain stitch base loop standing portion and the chain stitch initial loop;

p. inserting the threaded needle through the chain stitch base loop and the chain stitch initial loop while maintaining the needle above the material, creating a chain stitch finish loop having a chain stitch finish loop standing portion and a chain stitch finish loop running portion;

q. releasing the grip on the chain stitch base loop and the chain stitch initial loop and grasping the chain stitch finish loop standing portion;

r. while grasping the chain stitch finish loop standing portion, withdrawing the threaded needle from the chain stitch base loop;

s. repeating steps l. through r. on subsequent cross members along the edge, using the chain stitch finish loop as the chain stitch initial loop for the subsequent iteration; and t. securing the yarn to the mesh at a final boundary position.

11. The method of claim 9 wherein the step of applying the tension is by pulling the finish loop away from the finished side.

12. The method of claim 9 wherein the finished loop running portion is maintained in tension while said finish loop is pulled.

13. The method of claim 12 wherein step a. is accomplished by completing steps b. through l. at the predetermined cross member on the mesh.

14. The method of claim 8 for forming a chain stitch on the finished side of the mesh material wherein, in step a., the yarn is secured to the mesh so as to provide an initial loop at the predetermined cross member;

further wherein step d. includes grasping the initial loop along with the base loop standing portion so as to maintain the base loop alongside the initial loop;

still further wherein step f. includes passing the threaded needle through the initial loop after passing through the base loop;

yet further wherein step g. includes releasing the grasp on the initial loop; and wherein the method further comprises, after step h., repeating steps b. through h. with the finish loop becoming the initial loop for the next chain stitch iteration.

15. A method of filling a designated region of a mesh material with a stabilized open loop stitch which resides on a finished side of the mesh, the method comprising the steps of:

a. selecting a cross member on the mesh within the designated region;

b. passing the threaded needle from the finished side of the material through a mesh opening bounded by the selected cross member and under the cross member, and thereafter returning the needle to the finished side of the mesh material;

c. extending the needle a predetermined distance beyond the cross member so as to create a base loop having a base loop standing portion and a base loop running portion;

d. grasping the base loop standing portion with the hand not holding the needle;

e. withdrawing the threaded needle from the mesh material while maintaining a grasp on the base loop standing portion;

f. inserting the threaded needle through the base loop while maintaining the needle above the material, generating a finish loop having a finish loop standing portion and a finish loop running portion;

g. releasing the grasp on the base loop and grasping the finish loop standing portion;

h. withdrawing the threaded needle from the mesh material while maintaining a grasp on the finish loop standing portion so as to maintain the finish loop above the mesh;

l. applying tension to the base loop to stabilize the yarn and draw the base loop tight, generating a loop knot securing the finish loop to the cross member; and j. progressively advancing to adjacent cross members in the designated region and repeating steps b. through l. with respect to each subsequent cross member until such time as the designated region is filled.

16. The method of claim 15 wherein the mesh material is a stranded fabric which is polymer-coated and wherein the designated region includes the outer fibers of the mesh material.

17. The method of claim 15 wherein the index finger and thumb of the hand not holding the needle are employed to grasp the yarn in steps d. and g.

18. The method of claim 15 further filling a second designated region with a low profile chain stitch which resides on a finished side of the mesh, the method comprising the additional steps of:

k. selecting a second region cross member on the mesh at an extremity of the second designated region and creating an initial loop secured to the selected second region cross member;

l. passing the threaded needle from the finished side of the material through a mesh opening and under a cross member of the mesh material adjacent the selected second region cross member, hereafter defined as the active cross member, and thereafter returning the needle to the finished side of the mesh material;

m. extending the needle a predetermined distance beyond the active cross member so as to create a chain stitch base loop having a chain stitch base loop standing portion and a chain stitch base loop running portion;

n. grasping the chain stitch base loop standing portion with the hand not holding the needle so as to maintain the chain stitch base loop alongside the initial loop;

o. withdrawing the threaded needle from the mesh material while maintaining a grasp on the chain stitch base loop standing portion and the initial loop;

p. inserting the threaded needle through the chain stitch base loop and the initial loop while maintaining the needle above the mesh material, generating a chain stitch finish loop having a chain stitch finish loop standing portion and a chain stitch finish loop running portion;

q. releasing the grasp on the chain stitch base loop and the initial loop and grasping the chain stitch finish loop standing portion;

r. withdrawing the threaded needle from the mesh material while maintaining a grasp on the chain stitch finish loop standing portion so as to maintain the chain stitch finish loop above the mesh, the chain stitch finish loop serving as the initial loop for a subsequent chain stitch;

s. progressively advancing to adjacent cross members in the second designated region and repeating steps l. through r. with respect to each subsequent cross member until such time as the second designated region is filled.

19. A flexible, compliant, decorative fabric comprising:

a durable mesh material formed by an open matrix of cross members that bound an array of openings, said cross members being coated with an elastomer in such a manner as to leave an array of mesh openings in said mesh material, one of the surfaces of said mesh material being chosen as a finished side; and a looped overlayer formed by stitching through said mesh openings of said durable mesh material so as to attach said stitching to said cross members and leaving the array of mesh openings remaining in said mesh material, the stitching being configured such that said looped overlayer resides predominately above said finished side of said mesh material.

20. The decorative fabric of claim 19 wherein said mesh material further comprises:

an array of woven fibers which form said cross members that define the boundaries of said mesh openings; and an elastomer covering over said fibers while leaving said mesh openings remaining, to form said elastomer coating.

21. The decorative fabric of claim 20 wherein said looped overlayer is divided into regions, said regions being selected from the group of regions comprising:

open looped region; and plush low profile loop region.

* * * * *